US009592931B2

(12) United States Patent
Woodruff

(10) Patent No.: US 9,592,931 B2
(45) Date of Patent: Mar. 14, 2017

(54) STORAGE UNIT

(71) Applicants: Donna M Kilgore; Samuel A. Kilgore, Airville, PA (US); William L. Woodruff, Wrightsville, PA (US)

(72) Inventor: Virginia Woodruff, Wrightsville, PA (US)

( * ) Notice: Subject to any disclaimer, the term of this patent is extended or adjusted under 35 U.S.C. 154(b) by 0 days.

(21) Appl. No.: 14/502,658

(22) Filed: Sep. 30, 2014

(65) Prior Publication Data

US 2015/0090721 A1 Apr. 2, 2015

Related U.S. Application Data

(60) Provisional application No. 61/885,890, filed on Oct. 2, 2013.

(51) Int. Cl.

| | |
|---|---|
| ***B65D 25/04*** | (2006.01) |
| ***B65D 25/20*** | (2006.01) |
| ***B65D 25/06*** | (2006.01) |

(52) U.S. Cl.

CPC ..... *B65D 25/20* (2013.01); *B65D 25/06* (2013.01)

(58) Field of Classification Search

CPC ..... B65D 9/12; B65D 25/20; B65D 25/06
USPC ..... 220/533, 694
See application file for complete search history.

(56) References Cited

U.S. PATENT DOCUMENTS

| | | | | |
|---|---|---|---|---|
| 653,514 | A * | 7/1900 | Kasschau | 217/12 R |
| 2,440,207 | A * | 4/1948 | Owens | 206/553 |
| 2,530,481 | A | 11/1950 | Rawn, Jr. | |
| 4,577,773 | A * | 3/1986 | Bitel | 220/533 |
| 4,750,794 | A * | 6/1988 | Vegh | 312/263 |
| 5,457,858 | A * | 10/1995 | Lin | 24/511 |
| 5,884,371 | A * | 3/1999 | Huggins | 24/300 |
| 6,457,604 | B1 | 10/2002 | McNabb | |
| 6,925,689 | B2 * | 8/2005 | Folkmar | 24/499 |
| 7,124,990 | B1 | 10/2006 | Sanathra | |
| 2008/0191103 | A1 * | 8/2008 | Thurgar | 248/101 |
| 2011/0302745 | A1 | 12/2011 | Kirschbaum | |
| 2013/0048632 | A1 * | 2/2013 | Chen | 220/4.33 |

* cited by examiner

*Primary Examiner* — Fenn Mathew
*Assistant Examiner* — Don M Anderson
(74) *Attorney, Agent, or Firm* — Global Intellectual Property Agency, LLC; Daniel Boudwin

(57) ABSTRACT

A storage apparatus having a plurality of panels that can be placed into corresponding grooves forming a plurality of compartments having an enclosed interior volume and an open upper in which items, such as potato chip bags, can be stored therein. The interior panels may further comprise centrally located cutout holes in which an elastic cord can be inserted therethrough, which is connected to a pair of closure clips that are used to ensure the user has access to a closure clip when securing closed opened potato chips bags within the compartments. The storage apparatus is detachable, wherein each of the plurality of panels can be disconnected from one another and placed in a mesh bag for storage thereof. The plurality of panels can connect to one another via a sliding channel groove mechanism and/or a stopped dove tail or through dove tail channel groove mechanism.

8 Claims, 2 Drawing Sheets

STORAGE UNIT

CROSS REFERENCE TO RELATED APPLICATION

This application claims the benefit of U.S. Provisional Application No. 61/885,890 filed on Oct. 2, 2013. The above identified patent application is herein incorporated by reference in its entirety to provide continuity of disclosure.

BACKGROUND OF THE INVENTION

Field of the Invention

The present invention relates to storage systems and apparatuses. More specifically, the present invention pertains to storage apparatuses for holding potato chip bags in an upright position and other kitchen and/or food items such as plates, napkins, and cutlery.

Conventional methods of storing potato chip bags and other similar food items involve the use of bag clips in order to seal the previously opened potato chip bags. However, it can be difficult to store these bags in an upright position as they are substantially flat in structure and can fall over easily. Many individuals resort to storing these bags in a cabinet, drawer or shelf causing a messy and disheveled appearance. Further, these storage areas are not easily accessed by others when needed at a party and/or other social gathering.

Other food related items such as napkins, cutlery and plates are often stored on a tabletop, in a drawer or in various types of containers. Still, such methods of storage do not often involve storing these items in an upright position or in an organized fashion to which it can be readily accessible to others at a party, barbecue, or family dinner.

Accordingly, the present invention relates to a new and improved storage apparatus incorporating a plurality of compartments that include removable shelves having a plurality of bag clips attached thereto, wherein the device in its entirety is detachable and can be easily transported and/or stored on a shelf, tabletop, and countertop in an upright position for easy access thereto. The invention can further provide an alternative embodiment that can be utilized to store napkins, utensils and plates.

DESCRIPTION OF THE PRIOR ART

Devices have been disclosed in the prior art that relate to storage devices or sealing devices for potato chips bags or other food related items. These include devices that have been patented and published in patent application publications. These devices generally relate to storage devices for food items and other objects. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 7,124,990 to Sanathra discloses a potato chip bag holder that can be utilized to support a potato chip bag in an upright position having a semispherical base and a rounded bottom portion. The device provides a pair of intersecting slots that can engage the exterior surface of a potato chip bag. This device however, does not provide compartments for holding a plurality of potato chips bags and other items.

U.S. Pat. No. 6,457,604 to McNabb describes a holder that is designed to hold a bottle in an upright position. The device comprises an upper portion and a bottom portion, wherein the bottom portion is weighted and provides a rounded surface. The top portion includes a bottle holder in which a bottle can be inserted and held therein. The device can roll into an upright position no matter which way the bottle is inserted into the holder. While this helpful in the way of storing bottles in an upright position, it offers little utility for the storage of potato chip bags and other items that are not bottle shaped.

U.S. Publication No. 2011/0302745 to Kirschbaum provides for a bag clip with an elongated inverted teardrop structure. The device can be easily slid onto the top folded portion of a potato chip bag in order to keep it sealed and closed to the air. Although this device can facilitate the closure of potato chip bags, it does not provide a means for the storage of a plurality of potato chips bags and other objects. The present invention provides a storage device for potato chip bags and other items such as forks, knives, plates, napkins and spoons.

U.S. Pat. No. 2,530,481 to Rawn allows for a milk crate that provides vertical frame members and horizontal frame members that can be oriented in a rectangular fashion. The user can place a plurality of milk cartons therein for storage and transport. The present invention enables the user to place the device onto a table top, countertop or other easily accessible surface area in which food items such as potato chip bags, bread bags and cutlery can be placed and stored therein.

These prior art devices have several known drawbacks. The above discussed storage and/or bag clip devices do not provide for a potato chip bag or other foods related item storage apparatus having a plurality of compartments that include removable shelves and attached bag closure clips connected thereto.

It is submitted that the present invention substantially diverges in design elements from the prior art and consequently it is clear that there is a need in the art for an improvement to existing food item and/or utensil storage devices. In this regard the instant invention substantially fulfills these needs.

SUMMARY OF THE INVENTION

In view of the foregoing disadvantages inherent in the known types of storage devices now present in the prior art, the present invention provides a new storage apparatus having a plurality of compartments in which potato chip bags, utensils and other items can be stored therein, wherein the same can be utilized for providing convenience for the user when storing household and kitchen items such as potato chips bags, paper plates, napkins, and eating utensils.

It is therefore an object of the present invention to provide a new and improved storage apparatus that has all of the advantages of the prior art and none of the disadvantages.

It is another object of the present invention to provide a storage apparatus that is able to be disassembled.

Another object of the present invention is to provide a storage apparatus that is adapted for the storage of food items, such as potato chip bags.

Another object of the present invention is to provide a storage apparatus that can have an alternative embodiment that is adapted for the storage of utensils.

Another object of the present invention is to provide a storage apparatus that is adapted for the storage of dishware.

Another object of the present invention is to provide a storage apparatus that is adapted for the storage of napkins.

It is another object of the present invention to provide a storage apparatus that provides removable shelves.

It is another object of the present invention to provide a storage apparatus that is easily transportable.

It is another object of the present invention to provide a storage apparatus that is easily stored within cabinets or along kitchen countertops.

Another object of the present invention is to provide a storage apparatus that is adapted for the storage of utensils.

Yet another object of the present invention is to provide a storage apparatus that provides removable closure clips attached thereto for sealing opened bags placed therein.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
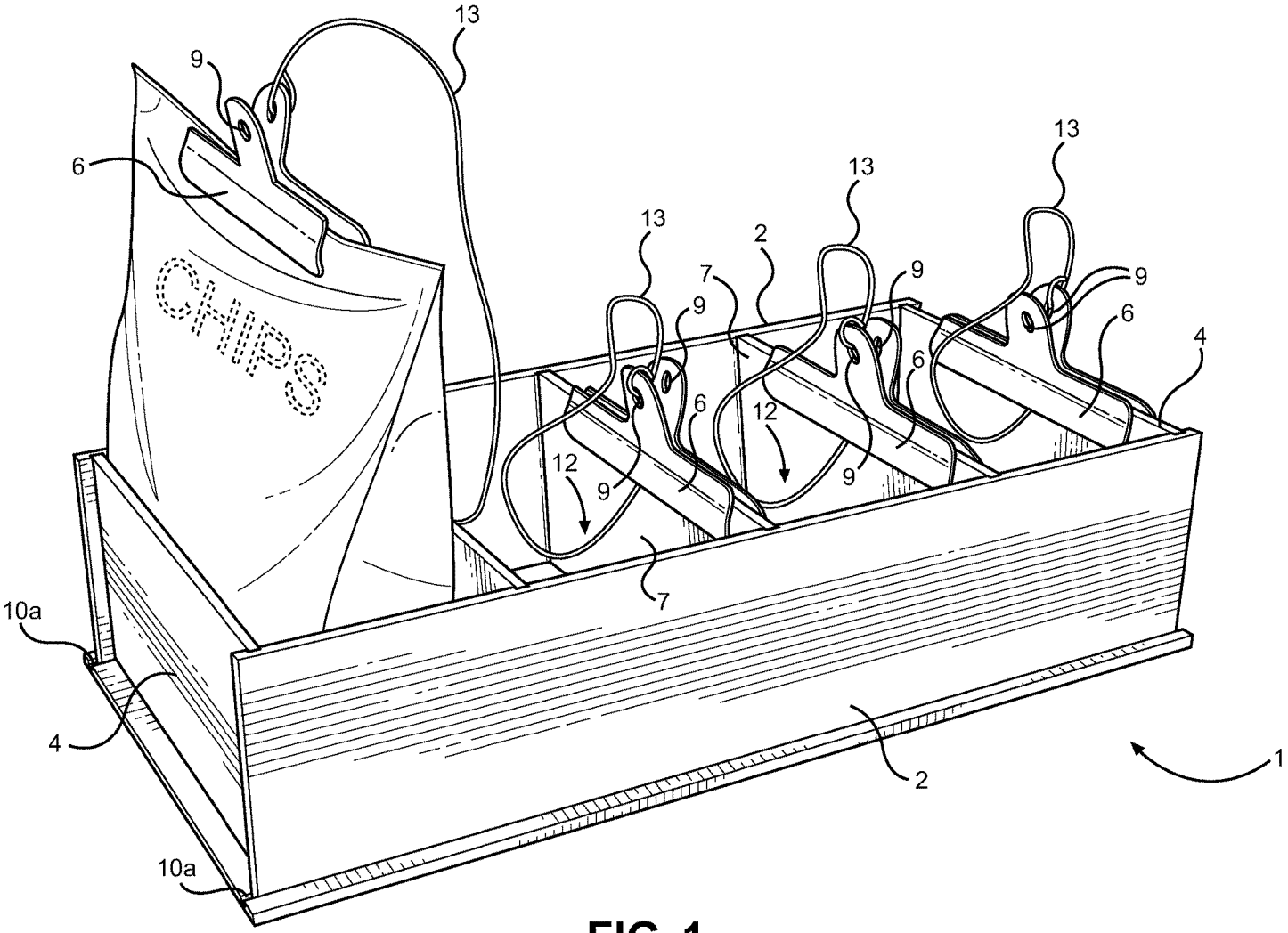
FIG. 1 shows a perspective view of the storage apparatus having a plurality of panels forming compartments and a plurality of corresponding closure clips attached thereto.

Reference is made herein to the attached drawings. Like reference numerals are used throughout the drawings to depict like or similar elements of the storage apparatus. For the purposes of presenting a brief and clear description of the present invention, the preferred embodiment will be discussed as used for storing various items, such as potato chip bags, utensils and other objects therein. The figures are intended for representative purposes only and should not be considered to be limiting in any respect.

Referring now to FIG. 1, there is shown a perspective view of the storage apparatus 1 comprising a compartmentalized and rectangular-shaped structure, in a preferred embodiment as shown, that includes a plurality of panels removably connected to one another via a sliding mechanism. The plurality of panels includes interior panels 7, a base panel 11, first exterior panels 2 and second exterior panels 4 and is collectively referred to as the "plurality of panels" and thus form the compartments 12 of the storage apparatus. The interior panels 7, base panel 11, first exterior panels 2 and second exterior panels 4 each have a top, bottom, a first side, second side and an outer perimeter edge. The sliding mechanism is accomplished by a channel groove mechanism, wherein the base panel 11 and first exterior panels 2 comprise channel grooves 10*a*, 10*b*, 10*c*. The channel grooves 10*a* of the base panel are located on the second side thereof and extend along the length of the outer perimeter and adjacent and thus parallel therewith.

Each of the plurality of interior panels 7 and one or more of the second exterior panels 4 provides a centrally located hole 9 in which an elastic cord 13, in a preferred embodiment as shown, can be inserted therethrough and further inserted through each of the centrally located holes 8 of the finger grips of the closure clips 6 and fastened via tying, in a preferred embodiment, thus allowing each of the closure clips 6 to be individually tethered to each of the interior panels 7 and/or second exterior panels 4. This ensures that the user always has access to a closure clip 6 in order to seal the bags or other items requiring sealing that are placed within the compartments 12 of the storage apparatus.

The tethering or restraining means of the elastic cords 13 to each of the interior panels 7 and/or the second exterior panels 4 is not limited to tying and can be accomplished via heat sealing, gluing and other suitable means. However, tying is the preferred means as it allows the user to remove the elastic cord 13 and/or closure clips 6 from the interior panels 7 and/or second exterior panels 4 in the event that the user wishes to store other items other than bags, within the compartments 12 and thus wishes to forgo the use of the closure clip 6 as a result thereof.

The closure clips 6 of the storage apparatus include a pair of opposing T-shaped closure members, each having a centrally located finger grip or handle area with a centrally located hole 9 therein and a gripping portion. The T-shaped closure members are pivotally connected to one another via a spring. Each T-shaped closure member includes a horizontal channel having an open interior end that forms a slightly curved structure, wherein the curved structure is concave in shape. The open interior ends of each T-shaped closure member contacts one another when in a closed position thus forming a gripping portion.

The user can place his or her thumb and forefinger onto the finger grip and apply manually pressure thereto in a squeezing motion in order to open the horizontal channels, thus pushing the horizontal channels of the T-shaped closure members away from one another. When the horizontal channels are held away from one another, the user can effectively place the channels over a resealed open upper of a bag, such as a potato chip bag. Once the user releases his or her fingers from the thumb grip of the T-shaped closure clips 6, the horizontal channels are forced toward one another via the spring and form a strong grip over the open upper of the bag, thus sealing it from external elements.

The closure clips of the storage apparatus are not limited to the embodiment described above and can include any suitable clip or clamping apparatus that can effectively seal or maintain bags or other items in a closed and/or sealed position from air, insects, pets and other external elements. The closure clips 6 can include clamp members, spring members, a fulcrum, jaws or other types of suitable clipping means, mechanisms or structures.

Figure 2:
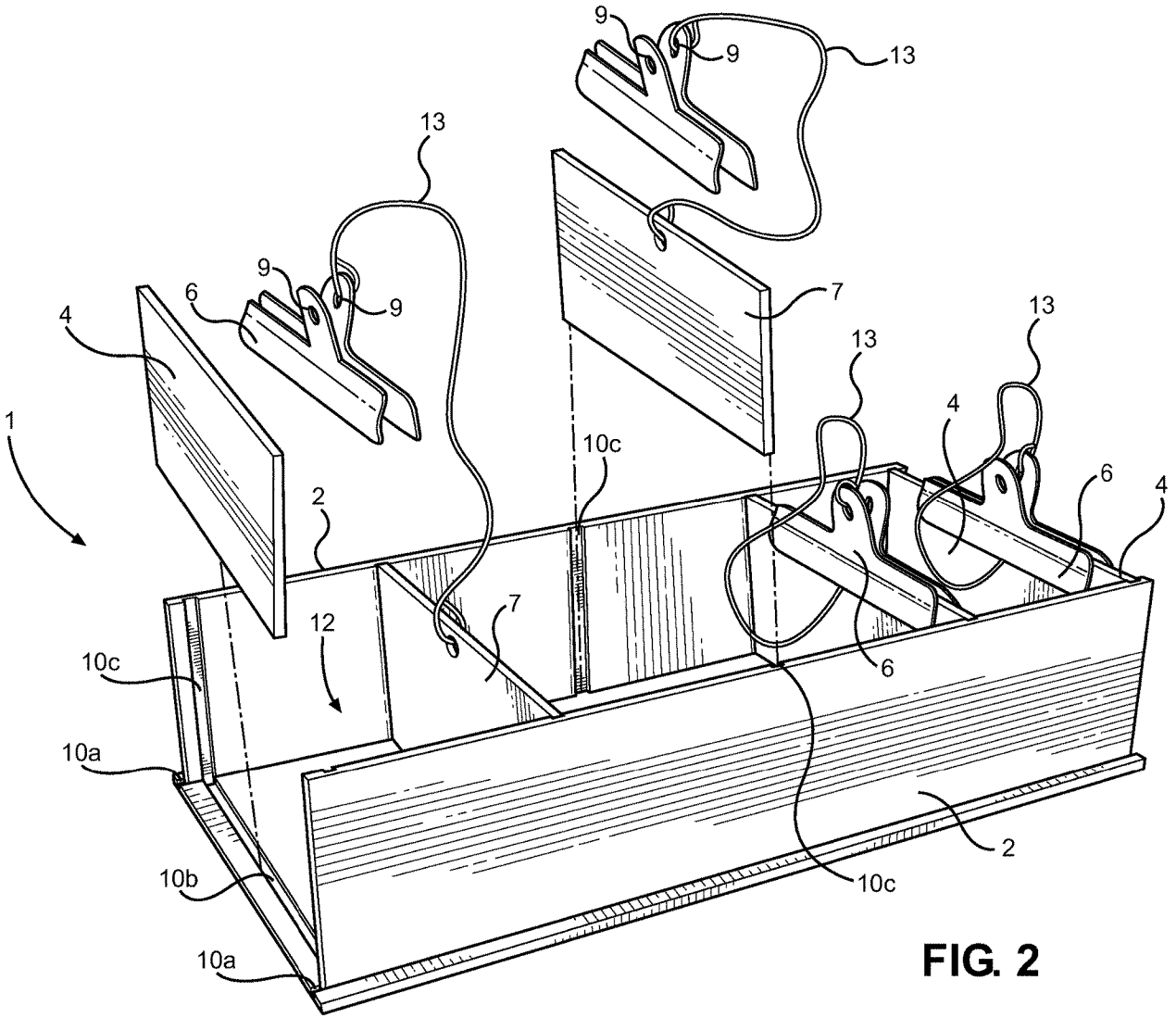
FIG. 2 shows a view of the storage apparatus having a plurality of panels forming compartments, wherein the panels include a sliding lock and channel groove mechanism and are thus detachable.

Referring now to FIG. 2, there is shown a view of the storage apparatus 1 having a plurality of panels forming compartments 12, wherein the plurality of panels include a sliding channel groove mechanism that can be a lock and channel groove mechanism and are thus detachable. The base panel 11 of the storage apparatus can be a rectangular shaped structure in a preferred embodiment having a first side and a second side and an outer perimeter edge, wherein the second side includes channel grooves 10*a*, 10*b* that extend along and are adjacent to or parallel with the outer perimeter edge thereof. There can be a channel groove 10*a* that extends lengthwise along each side of the outer perimeter edge of the base panel 11 and a channel groove 10*b* that extends widthwise along each side thereof and is thus perpendicular to the lengthwise channel groove 10*a*.

The channel grooves 10*a*, 10*b* can form one unitary body and thus present a rectangular shape that corresponds with the rectangular shape of the base panel 11 in a preferred embodiment or can terminate at each side of the base panel 11, thus forming an open terminal end. The user can manually place each of the first exterior panels 2 into the channel groove 10*a* located on each side of the base panel 11, thus fixed in an opposing arrangement to one another. The first exterior panels 2 can each provide a channel grooves 10*c* located on each side thereof having an open upper terminal end vertically disposed therein, in which the user can insert in a sliding manner, the second exterior panels 4 therein thus forming a ninety degree angle therewith. The bottom of each of the second exterior panels 4 can further be inserted into channel grooves 10*b* located on each side of the base panel 11, thus fixed in an opposing arrangement to one another, wherein each of the second exterior panels 4 are positioned perpendicularly to each of the first exterior panels 2. The channel groove mechanism is not limited to the preferred embodiment and can be a stopped sliding dove tail, a through sliding dove tail and/or other suitable channel groove means.

The first exterior panels 2 further provide channel grooves 10*c* vertically disposed along the second side thereof having an open upper terminal end in which the user can insert the interior panels 7 therein via manually sliding the bottom of each side of the interior panels into the open upper terminal end of each of the channel grooves 10 until the bottom of the interior panels 7 contact the second side of the base panel, thus forming a plurality of compartments 12 having an interior volume and an open upper. Each side of each of the interior panels 7 can rest within the channel grooves 10*c* of each of the first exterior panels 2, thus forming a ninety degree angle therewith and positioned perpendicularly thereto.

Once the user places the pair of opposing first exterior panels 2 into each of the channel grooves 10*a* located on the second side of the base panel 11 and inserts the interior panels 7 and the second exterior panels 4 into each of the corresponding channel grooves 10*c* vertically disposed along the side edges and thereinbetween of the second side of the first exterior panels 2, the user can then place various items therein for storage. The user is not limited to inserting all of the interior panels within the channel grooves 10*c* of the second side of the first exterior panels 2 and can choose to insert one or two of the interior panels 7, thus forming a larger compartment 12 if desired.

The user can decide to forgo inserting one of the interior panels 7 and can thus form the storage apparatus having one larger compartment and two smaller compartments. Similarly, a user can decide to forgo inserting two of the interior panels and can thus form the storage apparatus 1 having one substantially larger compartment and one small compartment. The storage apparatus can be constructed from plastic in a preferred embodiment, but is not limited to such a material and can be alternatively made from wood, recycled materials, rubber, vinyl and/or other suitable materials.

The storage apparatus 1 embodiment described above is not limited to such an embodiment and there can be alternative embodiments. An alternative embodiment can have smaller compartments 12, wherein the side edges of a first interior panel (not shown) and a second interior panel (not shown) having a first side and a second side (not shown) can be inserted into the open upper terminal end of corresponding channel grooves 10 of the second side of the first exterior panels, forming three compartments (not shown). A third interior panel (not shown) can be inserted into one of the two compartments (not shown) in a perpendicular orientation thereto into a vertically disposed centrally located channel grooves 10 (not shown) located on the first side of the first interior panel, thus further splitting the compartment into two separate compartments (not shown). Moreover, a fourth interior panel (not shown) and a fifth interior panel (not shown) can then be inserted into a pair of vertically disposed channel grooves 10 (not shown) having an open upper terminal end (not shown) located on the first side (not shown) of the second interior panel (not shown) forming three smaller compartments.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A storage apparatus, comprising:

a housing, said housing having a base panel, a first side, a second side, side edges and an outer perimeter edge; said base panel having channel grooves;

a pair of opposing first exterior panels having channel grooves, a first side, a second side, side edges, a top, bottom edges and an outer perimeter edge;

a pair of opposing second exterior panels having a first side, a second side, side edges, a top, a bottom, and an outer perimeter edge;

a plurality of interior panels removably insertable into said channel grooves on said base panel and said channel grooves on said pair of first exterior panels, said plurality of interior panels having a first side, a second side, side edges, a top, a bottom, side edges and an outer perimeter edge;

a plurality of spring-biased closure clips adapted to secure a bag in a closed configuration; and wherein each of the plurality of interior panels includes one of the plurality of spring-biased clips tethered thereto.

2. The storage apparatus of claim 1, said housing further comprising a rectangular shape, wherein said bottom edges of said pair of opposing first exterior panels are removably connected to said channel grooves of said base panel;

said side edges of said plurality of interior panels being removably connected to said channel grooves of said pair of opposing first exterior panels;

said bottom of said opposing second exterior panels being removably connected to said channel grooves of said base panel.

3. The storage apparatus of claim 1, said base panel further comprising a rectangular shape, wherein said second side of said base panel has channel grooves extending along each lengthwise side and parallel to said outer perimeter edge of said base panel and a second groove extending along each widthwise side and parallel to said outer perimeter edge of said base panel;

wherein said pair of opposing first exterior panels are adapted to lock into said channel grooves extending along each lengthwise side of said second side of said base panel; said channel grooves of said pair of opposing first exterior panels being vertically disposed on said second side of said first exterior panels, wherein said plurality of interior panels correspond therewith and slide and lock therein.

4. The storage apparatus of claim 3, wherein said plurality of interior panels further comprising a first interior panel, a second interior panel, and a third interior panel;

wherein said side edges of said first interior panel is insertable into said channel grooves of said second side of said pair of opposing first exterior panels, said side edges of said second interior panel is insertable into said channel grooves of said second side of said pair of opposing first exterior panels forming three compartments;

said third interior panel is insertable into one of said three compartments in a perpendicular orientation thereto into a said vertically disposed channel grooves located on said second side of said first exterior panels, thus further splitting said one of said three compartments into two compartments.

5. The storage apparatus of claim 1, wherein said plurality of interior panels further comprise a cutout hole.

6. The storage apparatus of claim 1, said closure clips having a pair of opposing T-shaped closure members and a finger grip with a centrally located cutout hole and a gripping portion, said T-shaped closure members pivotally connected to one another via a spring.

7. The storage apparatus of claim 6, said connection of said closure clips to said plurality of interior panels being cords extending through said centrally located cutout hole of said finger grip and further extending through a centrally located hole of said second exterior panels and a centrally located hole of said plurality of interior panels thus affixing said closure clips to said interior panels and to said pair of opposing second exterior panels.

8. The storage apparatus of claim 1, wherein each of said closure clips are tethered to at least one of said plurality of interior panels via an elastic cord.

* * * * *